US009010966B2

(12) United States Patent
Maeda et al.

(10) Patent No.: US 9,010,966 B2
(45) Date of Patent: Apr. 21, 2015

(54) OPTICAL ARRAY FOR LED BULB WITH THERMAL OPTICAL DIFFUSER

(71) Applicant: Palo Alto Research Center Incorporated, Palo Alto, CA (US)

(72) Inventors: Patrick Yasuo Maeda, San Jose, CA (US); Ashish Pattekar, Cupertino, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 92 days.

(21) Appl. No.: 13/973,451

(22) Filed: Aug. 22, 2013

(65) Prior Publication Data

US 2015/0055340 A1 Feb. 26, 2015

(51) Int. Cl.
*F21V 29/00* (2006.01)
*F21K 99/00* (2010.01)

(52) U.S. Cl.
CPC ..... *F21V 29/004* (2013.01); *F21K 9/50* (2013.01); *Y10S 362/80* (2013.01)

(58) Field of Classification Search
USPC ..... 362/249.02, 311.02, 545, 294, 218, 362/373, 547, 800
See application file for complete search history.

(56) References Cited

U.S. PATENT DOCUMENTS

| | | | | |
|---|---|---|---|---|
| 8,764,247 | B2 * | 7/2014 | Pattekar et al. | 362/294 |
| 2007/0159828 | A1 | 7/2007 | Wang | |
| 2009/0103293 | A1 | 4/2009 | Harbers et al. | |
| 2010/0002430 | A1 * | 1/2010 | Liou et al. | 362/235 |
| 2010/0133578 | A1 * | 6/2010 | Pickard et al. | 257/99 |
| 2010/0314985 | A1 | 12/2010 | Premysler | |
| 2011/0080096 | A1 | 4/2011 | Dudik et al. | |
| 2011/0115358 | A1 | 5/2011 | Kim | |
| 2011/0156584 | A1 | 6/2011 | Kim | |
| 2011/0267801 | A1 | 11/2011 | Tong et al. | |
| 2012/0057327 | A1 | 3/2012 | Le et al. | |
| 2012/0080699 | A1 | 4/2012 | Chowdhury et al. | |
| 2012/0188767 | A1 | 7/2012 | Igaki et al. | |
| 2012/0268936 | A1 * | 10/2012 | Pickard et al. | 362/249.02 |
| 2012/0287610 | A1 * | 11/2012 | Krogman | 362/152 |
| 2013/0107530 | A1 | 5/2013 | Wyrick et al. | |

FOREIGN PATENT DOCUMENTS

| | | |
|---|---|---|
| EP | 1453107 | 9/2004 |
| WO | WO2009071111 | 6/2009 |
| WO | WO2011109092 | 9/2011 |
| WO | WO2011109098 | 9/2011 |

* cited by examiner

*Primary Examiner* — Laura Tso
(74) *Attorney, Agent, or Firm* — Hollingsworth Davis, LLC

(57) ABSTRACT

An LED light bulb includes a thermally conductive base and at least one LED assembly disposed on the base. The LED assembly includes at least one LED configured to emit light. A thermal optical diffuser defines an interior volume of the LED light bulb. The LED is arranged to emit light into the interior volume and through the thermal optical diffuser. The thermal optical diffuser extends from the base to a terminus on a light emitting side of the LED assembly. The thermal optical diffuser includes one or more openings. An array of optical elements is disposed within the interior volume and is configured to focus the emitted light toward the openings. The thermal optical diffuser and the array of optical elements are arranged to allow convective air flow between the interior volume of the thermal optical diffuser and ambient environment.

20 Claims, 14 Drawing Sheets

OPTICAL ARRAY FOR LED BULB WITH THERMAL OPTICAL DIFFUSER

TECHNICAL FIELD

This application relates generally to light emitting diode (LED) light bulbs. The application also relates to components, devices, and systems pertaining to such LED light bulbs.

BACKGROUND

Light emitting diode (LED) light bulbs can substantially increase residential and commercial energy efficiency if they achieve sufficient market adoption. However, commercially available designs are presently limited to 60 Watt-equivalent (We) luminosity. Market adoption is hindered by the lack of LED bulbs capable of replacing the common 75 W and 100 W incandescent bulbs to consumer satisfaction. Thermal management is a primary technology barrier to achieving higher luminosity in current LED bulb designs. State of the art approaches rely on heat sinks that remove heat only from the backside of the LED bulbs, so as not to interfere with the light output path on the front side. This constrains the heat rejection area to the region behind the LED, leading to high temperatures, lower efficiency, and shortened life.

A limiting factor in the widespread adoption of LED light bulbs has been the lack of units capable of replacing the most common 75 W and 100 W incandescent light bulbs. LED bulb designs in the incandescent replacement market today are limited to a maximum of 60 Watt-equivalent (We) operation, covering only the lower end of the potentially large retrofit market.

Thermal management is a primary technology barrier to achieving higher luminosity in LEDs. Maintaining the incandescent form factor supports mass adoption without requiring entirely new luminaires, and this forces the entire light source (including the driver electronics, LED chip(s), light diffuser, and heat sink) to be tightly packed into a small form factor. This small form factor leads to a challenging thermal management problem.

In a typical 11 to 12 W (electric) LED bulb with 60 We luminosity, about 15% (~2 W) of the total electricity is wasted as heat in the driver electronics, and of the remaining 85% (~10 W), at least half (~5 to 6 W) is dissipated as heat in the LED chip itself. Inefficient rejection of all this heat through the limited surface area available on the backside of the bulb leads to overheating at operating levels beyond the 60 We available today.

SUMMARY

Embodiments involve a light emitting diode (LED) light bulb. The LED light bulb includes a thermally conductive base and at least one LED assembly disposed on and thermally coupled to a surface of the base. The at least one LED assembly includes at least one LED configured to emit light. A thermal optical diffuser defines an interior volume of the LED light bulb. The at least one LED is arranged to emit light into the interior volume and through the thermal optical diffuser. The thermal optical diffuser is disposed on the surface of the base and extends from the base to a terminus on a light emitting side of the LED assembly. The thermal optical diffuser configured to include one or more openings. An array of optical elements is disposed within the interior volume and is configured to focus the emitted light toward the openings. The thermal optical diffuser and the array of optical elements are arranged to allow convective air flow between the interior volume of the thermal optical diffuser and ambient environment.

Some embodiments disclosed herein involve an LED light bulb that includes a thermally conductive base and at least one LED assembly disposed on and thermally coupled to a surface of the base. The LED assembly comprises at least one LED configured to generate light. The LED light bulb includes a thermal optical diffuser that defines an interior volume wherein the at least one LED is configured to emit light into the interior volume and through the thermal optical diffuser. The thermal optical diffuser includes one or more openings or light transmissive regions. The thermal optical diffuser is disposed on the same surface of the base as the LED assembly and extends from the surface of the base to a terminus. The thermal optical diffuser comprises a material having a thermal conductivity greater than about 100 W/(mK). An array of optical elements is disposed within the interior volume and is configured to focus the emitted light toward openings and/or transmissive regions. The thermal optical diffuser and the array of optical elements are arranged to allow convective air flow between the interior volume of the thermal optical diffuser and ambient environment.

Some embodiments include a subassembly for light emitting diode (LED) light bulb. The subassembly includes a thermal optical diffuser that defines an interior volume such that light emitted by a LED disposed within the interior volume travels in the interior volume and emerges through holes or other transmissive regions of the thermal optical diffuser. The thermal optical diffuser is configured to extend on the light emitting side of the LED light bulb from a base to a terminus. An array of optical elements is disposed within the interior volume and is configured to focus the emitted light toward the openings and/or transmissive regions. The thermal optical diffuser and the array of optical elements are arranged to allow convective air flow between the interior volume of the thermal optical diffuser and ambient environment.

The above summary is not intended to describe each embodiment or every implementation. A more complete understanding will become apparent and appreciated by referring to the following detailed description and claims in conjunction with the accompanying drawings.

BRIEF DESCRIPTION OF THE DRAWINGS

In these drawings, like reference numbers refer to like components. Drawings are not necessarily to scale unless otherwise indicated.

DETAILED DESCRIPTION OF VARIOUS EMBODIMENTS

Embodiments discussed herein involve approaches for thermal and optical management of LED light bulbs that enable removal of a significant amount of heat from the light emitting side of LEDs without compromising light transmission. Embodiments are directed to a condenser array and thermal and optical diffuser (CATOD). The condenser array (CA) directs and/or focuses light emitted by the LED towards a thermal optical diffuser (TOD). The CATOD may be an engineered element that provides a large surface area for heat dissipation to ambient air. In some implementations, the external surface of the CATOD can include a number of openings that support convective airflow from the ambient environment into the interior of the thermal optical diffuser. In some configurations, the air flow path is arranged so that ambient air enters the interior volume of the thermal optical diffuser and air flows over a light emitting surface of the LED. The approaches described herein have the potential to enable practical LED bulbs at 100 We and beyond, providing coverage of the incandescent market, increasing LED adoption, and decreasing near term electrical demand.

Figure 1A:
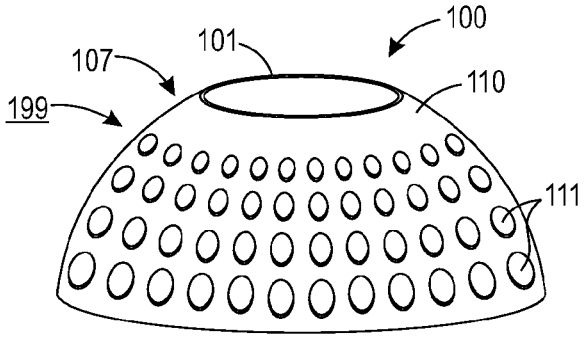
FIG. 1A is a perspective view of a portion of a light emitting diode (LED) light bulb that includes a condenser array and thermal optical diffuser (CATOD) in accordance with some embodiments.
Figure 1B:
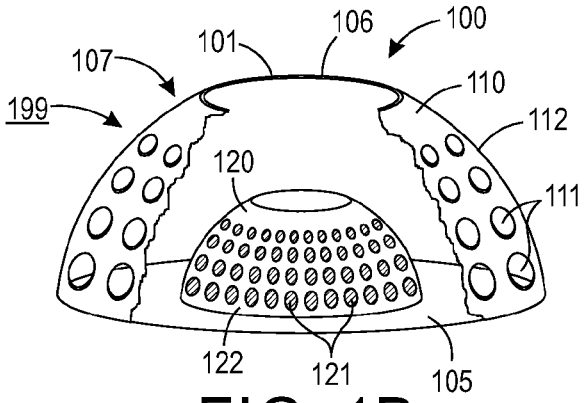
FIG. 1B is a cutaway view of the CATOD of FIG. 1A showing the external surface of the condenser array within the thermal optical diffuser.
Figure 1C:
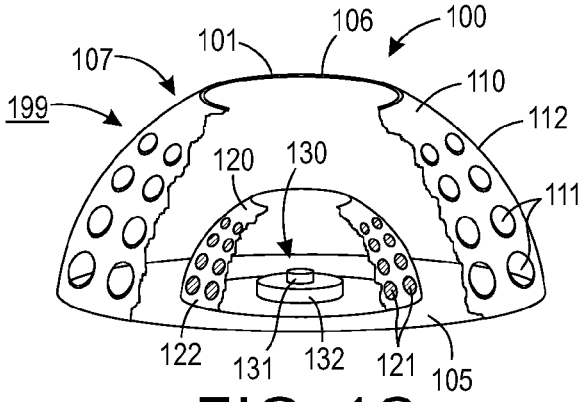
FIG. 1C is a cutaway view of the CATOD showing an LED assembly disposed within the condenser array of the CATOD of FIG. 1A.
Figure 1D:
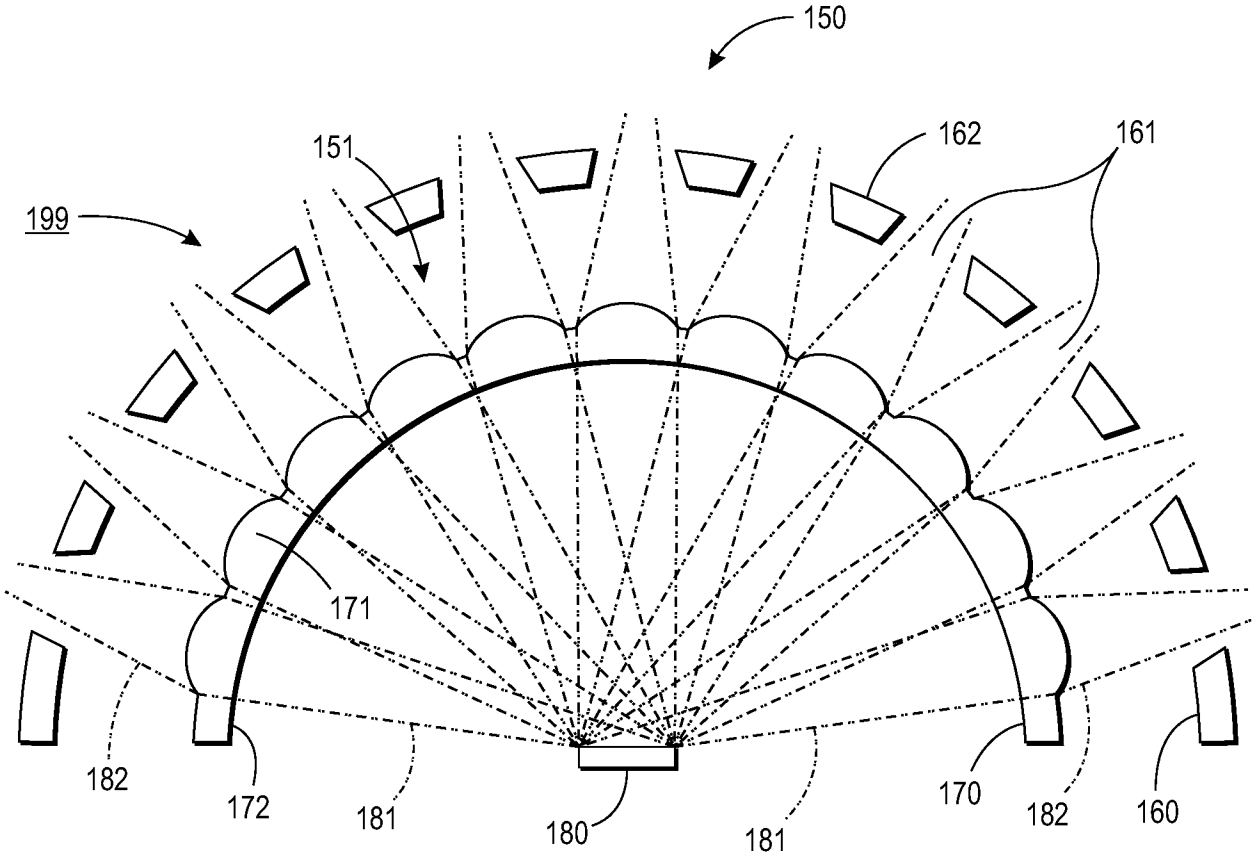
FIG. 1D is a cross sectional view of a CATOD illustrating CATOD operation.

FIG. 1A is a perspective view of a portion of an LED light bulb 100 that includes a CATOD 107 in accordance with some embodiments. FIG. 1B is a cutaway view of the CATOD 107 of FIG. 1A showing the external surface of the condenser array 120 within the thermal optical diffuser 110. FIG. 1C is a cutaway view of the CATOD 107 showing an LED assembly 130 disposed within the CA 120 of the CATOD 107. FIG. 1D is a cross sectional view of a CATOD 150 illustrating CATOD operation.

As depicted in FIGS. 1A-1D, the CATOD 107 comprises a thermal optical diffuser (TOD) 110 and a condenser array (CA) 120. The CATOD 107 defines an interior volume 101. The LED bulb 100 includes at least one LED 131 that is arranged to emit light into the interior volume 101 of the CATOD 107 and through the CA 120 and through the TOD 110. The LED 131 may be part of an LED assembly 130 that includes a substrate 132 upon which one or more LEDs are arranged. The CATOD 107 is disposed on the surface 105 of a base and extends from the surface 105 of the base to a terminus 106 on a light emitting side of the LED 131.

The TOD 110 includes a TOD structural support 112 that has one or more openings 111 and/or optically transmissive elements that allow light to pass through the TOD. Some embodiments include openings and, if openings are included in the TOD, the openings extend between the external ambient environment 199 and the internal volume 101.

The CATOD 120 includes a condenser array (CA) 120 comprising optical elements 121 disposed within the interior volume 101. The optical elements 121 are supported by an array support structure 122 and are configured to focus the light emitted by the LED 131 toward the openings 111 in the TOD 110. The CATOD is arranged to allow convective air flow between the interior volume of the CATOD 110 and ambient environment 199.

FIG. 1D illustrates the operation of a CATOD 150 that includes a CA 170 and TOD 160. The TOD 160 includes structural element 162 that includes openings 161 that extend between the internal volume 151 of the CATOD 150 and the ambient environment 199. The CA 170 includes an array support structure 172 that supports optical elements 171. The LED 180 generates light 181 that interacts with the optical elements 171, e.g., by diffraction or refraction. The optical elements 171 direct and/or focus the light emitted by LED 180 toward the openings 161 in the TOD 160. The directed and/or focused light 182 travels through the openings 161 and emerges from the CATOD 150.

In some implementations, the CA may be formed as a unitary, one-piece structure. In some embodiments, the TOD may be formed as a unitary, one-piece structure. In some embodiments, the entire CATOD may be formed as a unitary, one piece structure.

The array of optical elements in the CA may be one or both of diffractive and refractive optical elements. In addition to openings, the TOD may include optically transmissive regions that are not openings. The CA of the CATOD can be configured to focus the light emitted by the LED toward the openings of the TOD and/or toward the optically transmissive regions in the TOD.

The optical elements may be arranged in any pattern to direct and focus the light toward the openings and/or optically transmissive regions of the TOD. For example, the optical elements of a CA may be arranged in one or more of an aperiodic array, an anamorphic array, an asymmetrical array, an irregular array, a periodic array, a symmetrical array, a radially symmetrical array, and a regular array. In some embodiments each of the optical elements in the CA has substantially similar optical characteristics. In some embodiments, some of the optical elements in the CA have optical characteristics that are different from other optical elements in the array. For example, to achieve an anamorphic light distribution emanating from the CA may involve optical elements having optical characteristics that change over the array surface. In some embodiments, the pattern of openings of the TOD corresponds to or is similar to the pattern of optical elements in the CA.

The CA may have any shape, e.g., concave or convex, and may be made from any suitable material, such as plastic or glass, that can provide the desired optical characteristics. The CA may be formed by casting, stamping, molding, machining, cutting, 3-D printing, selective laser sintering (SLS), or any other suitable fabrication process. In some implementations, the CA may be a film that is arced, folded, molded, or otherwise formed into the desired shape. In some embodiments, the CA may be a multi-layer structure with a first layer providing the structural support and a second layer providing the optical elements. The first layer may be optically transmissive or may have optically transmissive regions that correspond to the location of the optical elements. As shown in FIGS. 1A-1C, the CA includes one or more openings, e.g., a central opening and/or openings along the sides of the CA. For example, the CA can include openings in the CA support structure between the optical elements.

The CA structural support may be light transmissive or opaque. The array support structure can be thermally conductive, e.g., having a thermal conductivity similar to the thermal conductivity of the TOD. In some embodiments, the optical elements may be made of a good thermal conductor material. For example, diamond, sapphire, mica, and/or some ceramics can provide suitable optical characteristics and good thermal conductivity.

Figure 1E:
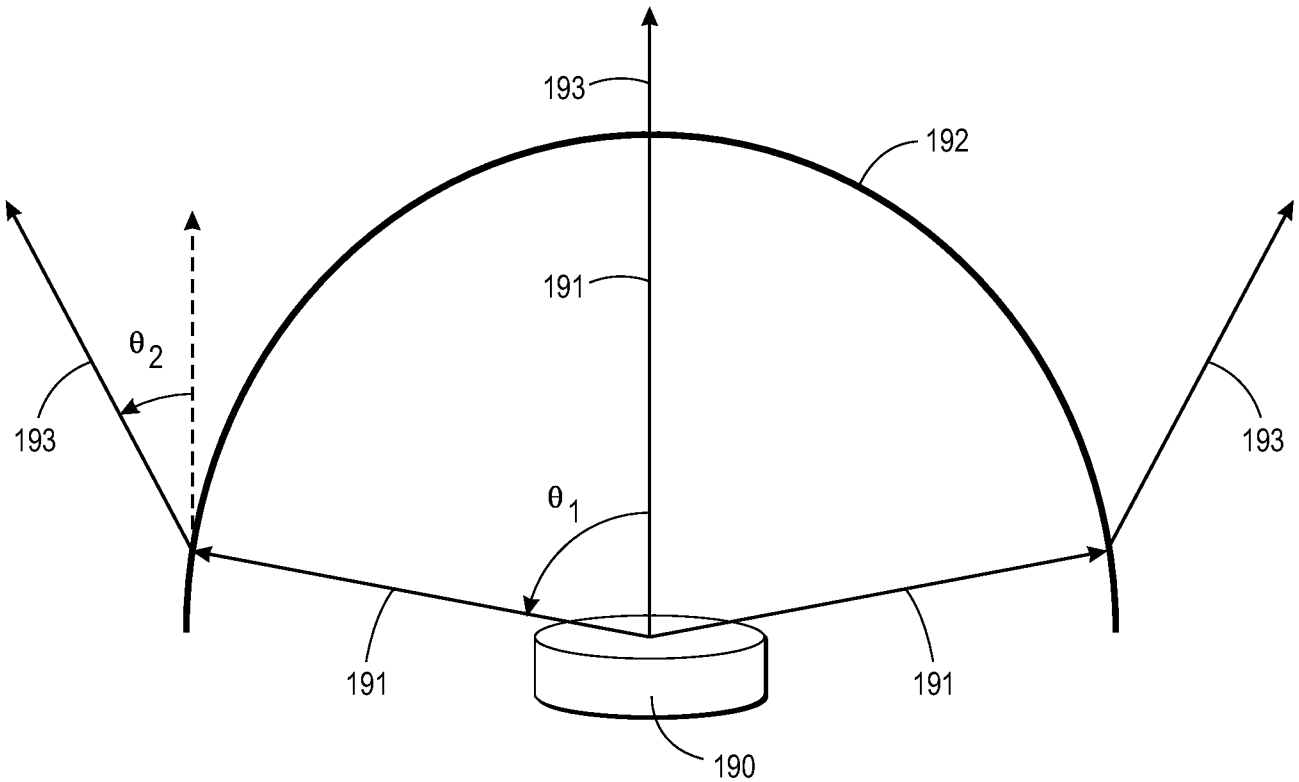
FIG. 1E illustrates a CATOD in accordance with some embodiments that alters the spatial radiation pattern of light emitted by the LED.

In some embodiments, the CA may be configured to change the spatial radiation pattern of the light emitted by the LED into a different spatial radiation pattern. As illustrated in FIG. 1E, the spatial radiation pattern of light 191 emitted by the LED 190 may be characterized by a first angle, $\theta_1$. The light 191 interacts with the CA 192 which changes the spatial radiation pattern of the light 191. The spatial radiation pattern of the light 193 emerging from the CA 192 may be characterized by a second angle, $\theta_2$, where $\theta_1 \neq \theta_2$.

Figure 1F:
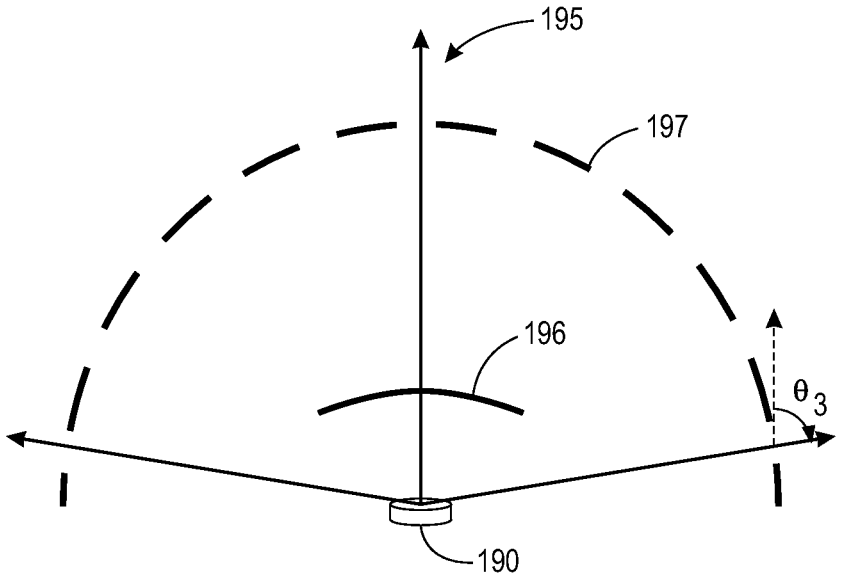
FIGS. 1F and 1G show a CATOD having a condenser array that can be deployed and retracted to change the spatial radiation pattern of the LED light bulb.
Figure 1G:
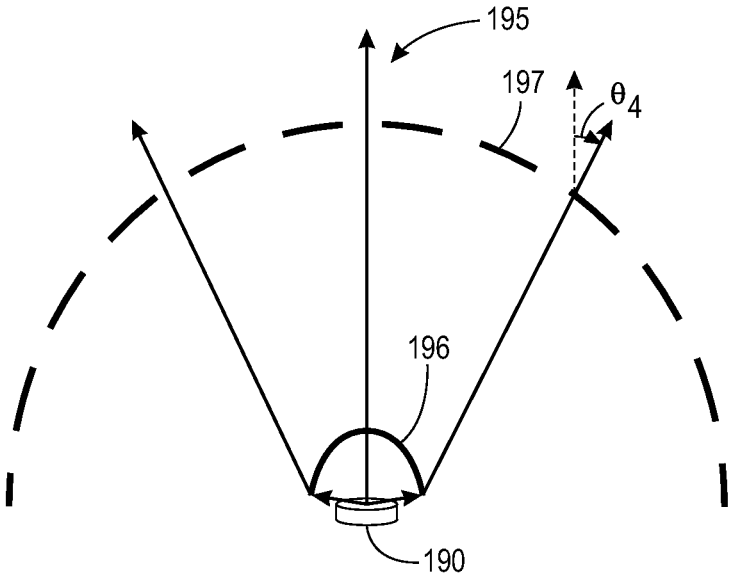

In some embodiments, the CA may be deployable, e.g., like an umbrella, to change the spatial radiation pattern of light that emerges from the CATOD. FIG. 1F shows a CA 196 of a CATOD 195 that is deployed in an more open, flatter configuration, providing a spatial distribution characterized by angle $\theta_3$ emerging through the TOD 197 of the CATOD 195. FIG. 1G shows the CA 196 retracted into a more closed, curved arrangement. The curved arrangement of the CA 196 provides a spatial distribution characterized by angle $\theta_4$ emerging through the TOD 197 of the CATOD 195.

The exterior surface of the TOD forms the exterior surface of the CATOD. The exterior surface of the CATOD is oriented toward the ambient environment and has a surface area greater than 4 $cm^2$ per about 1 $cm^3$ of interior volume.

Figure 2A:
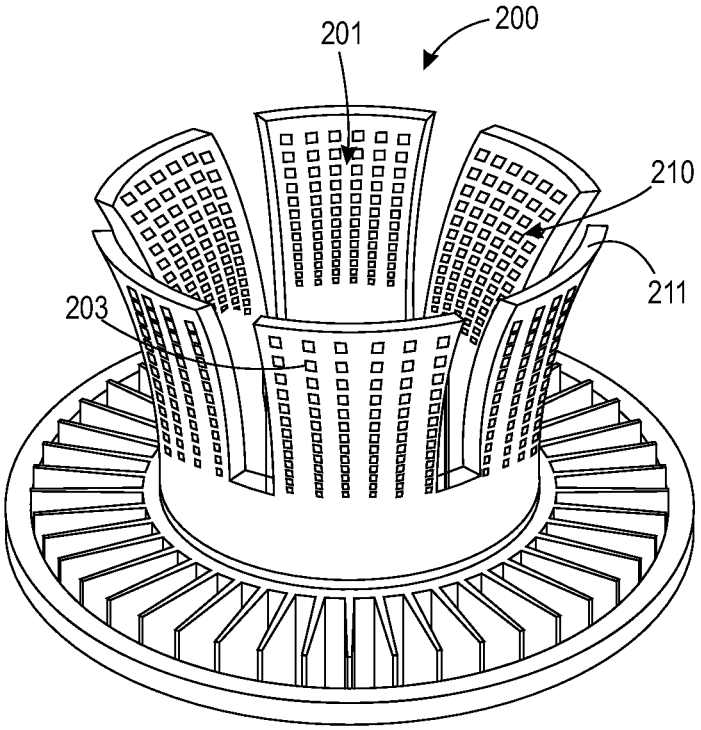
FIGS. 2A and 2B are perspective and cross section views, respectively, of one configuration of portion of an LED light bulb that includes a CATOD according to embodiments discussed herein.
Figure 2B:
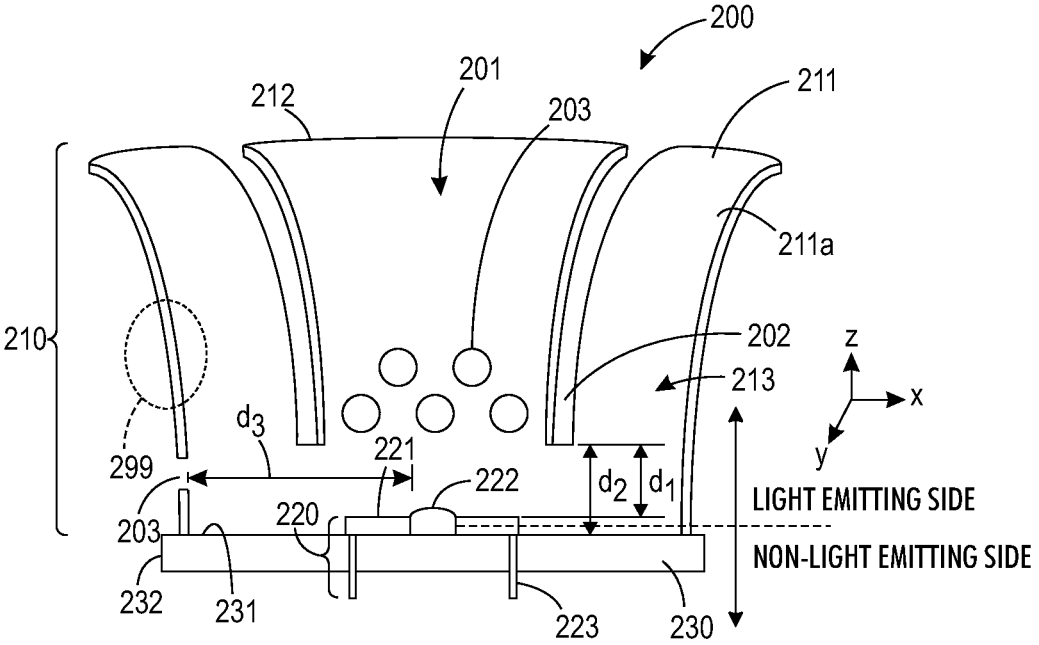

FIGS. 2A and 2B provide further details regarding the structure of a TOD that may be used in conjunction with a condenser array (CA) to form a CATOD as described herein. For simplicity the CA is omitted from these figures.

FIGS. 2A and 2B are perspective and cross section views, respectively, of one configuration of portion of an LED light bulb 200 that includes a TOD 210 oriented within a Cartesian coordinate system as indicated by mutually orthogonal axes, x, y, and z. The light bulb 100 includes a thermally conductive base 230 and at least one LED assembly 220 including one or more LEDs 222 assembled in packaging 221, e.g., hermetically sealed packaging that provides some environmental protection for the LEDs 222 and provides support for the LEDs 222 to facilitate handling. The LED assembly 220 includes electrical contacts 223 that are useful for electrically coupling the LEDs 222 to driver electronics (not shown in FIG. 1 or 2) which is located within the LED light bulb 100, typically within the non-light emitting side of the bulb. The LED assembly 220 is disposed on the surface 231 of the base 230 and is thermally coupled to the base 230.

The base 230 may comprise a thermally conductive material, such as a metal or a metal alloy, with copper or aluminum in pure or alloyed form being representative materials that can be used for the base 230. The base 230 may have any shape, including circular, elliptical, rectangular, etc., and may have proportions that allow it to be arranged within typical incandescent light bulb form factors such as type A, B, BR/R, BT, G, MR, PAR, R/K, or T, etc. The base 230 has a surface area and thickness sufficient to provide heat sinking for the LED assembly 220. For example, in various configurations, the base 230 may have dimensions of about 10 to 15 $cm^2$ surface area and thickness of about 1 to 4 cm.

The CATOD can be attached permanently, e.g., by welding braising, soldering, riveting to the base or may be attached to the base using removable fasteners, such as screws. In some implementations, the base 230 and the TOD 210 or the entire CATOD may be a one-piece unit. As illustrated in FIGS. 2A and 2B, the TOD 210 or CATOD may be attached to the same surface 231 of the base 230 as the LED assembly 220. The TOD 210 or CATOD may also be attached to other surfaces of the base 230 such as one or more sides 232 of the base 230. The TOD 210 may comprise one or more structural elements 211 that extend, individually or in combination, from the base 230 to a terminus 212 which is the farthest point of the TOD 210 from the base 230 along the z axis.

In the illustrated example of FIGS. 2A and 2B, the structural elements 211 of the TOD 210 resemble petals which extend (along the z direction in FIG. 2B) and expand outward (along the x and y directions in FIG. 2B) from the base 230. The structural elements 211 define an interior volume 213. The interior volume 213 extends from the base 230 to the terminus 212, and between the inner surfaces 211 a of the structural elements 211. Structural geometry of the TOD may be selected such that the TOD provides a surface area in contact with ambient air of at least 4 $cm^2$ for every 1 $cm^3$ of volume of the TOD. The structural geometry of the TOD enhances total light output of the LED assembly and enables overall bulb dimensions similar to an incandescent bulb of equivalent luminosity.

The LED assembly 220 is disposed within the interior volume 213 and is oriented so that the one or more LEDs 222 emit visible light into the interior volume 213 and through a portion of the interior volume to the ambient environment outside the CATOD. The term "light" as used herein is used to refer to visible light, typically comprising of electromagnetic radiation of wavelengths in the range of 390 nanometers to 750 nanometers. The light bulb 100 shown in FIGS. 2A and 2B can be thought of as having a light emitting (front) side and a non-light emitting (back) side, with the CATOD arranged primarily on the light emitting side. In some cases, the light projected into the interior volume 213 may exit the CATOD through openings 201-203 in the TOD 210. For example, the openings 201-203 may be arranged between (e.g., gaps 202) or through (e.g., holes 203) structural members 211. For example, FIG. 2B illustrates gaps 202 between the structural members 211, holes 203 through the structural members 211 and a large opening 201 near the terminus 212 of the TOD 210. In some implementations, as discussed below, the openings 201-203 may be arranged between the TOD 210 and the base 230. In other implementations, there may be no dominant (large) opening such as 201; this would be the case where the TOD consists solely of a structural element with a selected distribution of a number of small openings such as 202 and 203 arranged at various locations on and within the TOD including at and near the terminus plane.

If openings are present in the TOD 210, the openings may be arranged so that convective airflow occurs between ambient environment and the interior volume 213 of the CATOD. In this regard, the convective airflow brings cooler, ambient air into the interior volume 213 and allows exit of air within the interior volume 213 that has been heated by the LEDs 222. The CATOD can be designed so that the flow path of air from the ambient environment flows over the base 230, or flows over the LED assembly 220, including over the light emitting surface of the LED 222. The TOD defines the outer surface of the CATOD. The TOD geometry may be selected so as to have a large surface area of the TOD in contact with the freely flowing ambient air, so as to maximize the amount of heat removed from the bulb to the ambient environment.

As shown in FIG. 2B, openings 202, 203 can be arranged in relation to the LED assembly 220 and/or the surface 231 of the base 230 so that the distance in the z direction between the LED assembly 220 and closest opening 202, 203 is $d_1$, the distance in the z direction between the surface 231 of the base 230 and closest opening 202, 203 is $d_2$; and the distance in the xy plane between the closest opening 202, 203 and the LED assembly 220 is $d_3$. For example, the LED assembly 220, base 230, and TOD 210 may be arranged so that $d_1$ is less than about 8 mm, $d_2$ is less than about 10 mm, and/or $d_3$ is less than about 20 mm In contrast to traditional LED bulb designs that rely on a heat sink located on the backside (non-light emitting side) of the bulb alone, the integrated CATOD approach described herein enables substantial heat removal from the front (light-emitting) side of the bulb, in addition to the traditional back-side heat removal.

Removal of heat from the light emitting side becomes especially important in applications wherein the air flow and (therefore the ultimate heat transfer rate) on the backside of the bulb may be severely limited. For example, the backside heat sink of the typical LED bulb is frequently located inside a luminaire enclosure and therefore exposed to impeded air flow/stagnant air (e.g., in fixtures such as those used for recessed lighting.) Moreover, in the case of ceiling recessed lighting, the backside of the bulb may be exposed to the hot environment inside the attic—further reducing the heat removal rate from a bulb utilizing only a backside heat sink.

By utilizing the freely flowing air on the light emitting side of the bulb, and effectively coupling the heat generated in the bulb to the freely flowing ambient air on the front-side with the integrated optical and thermal diffuser, the designs discussed herein provide lower overall operating temperatures and longer device lifetime as will be discussed in the examples below.

Figure 3:
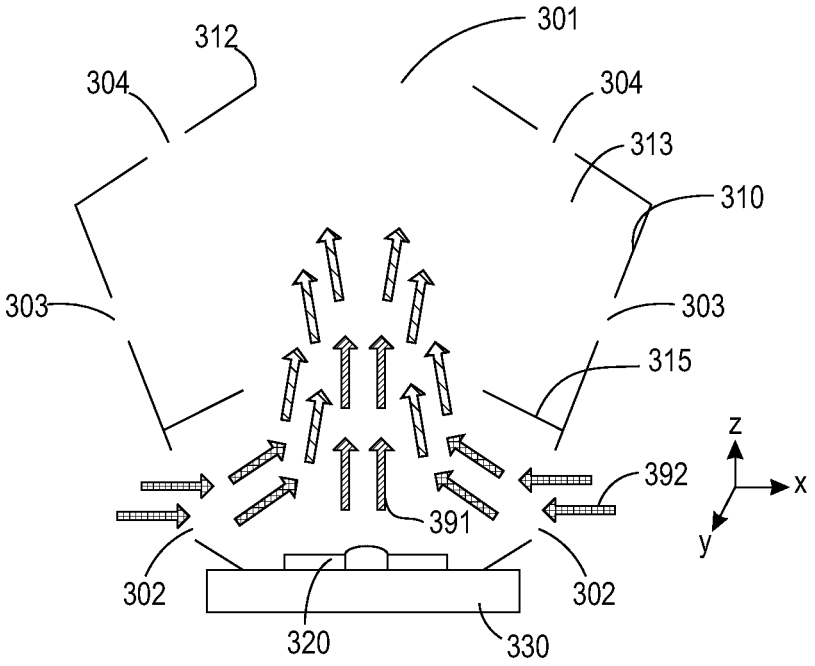
FIG. 3 diagrammatically illustrates convective airflow through the CATOD when the light bulb is oriented so that the TOD extends from the base to the terminus in the positive z direction referred to as the "bulb up" orientation.
Figure 4:
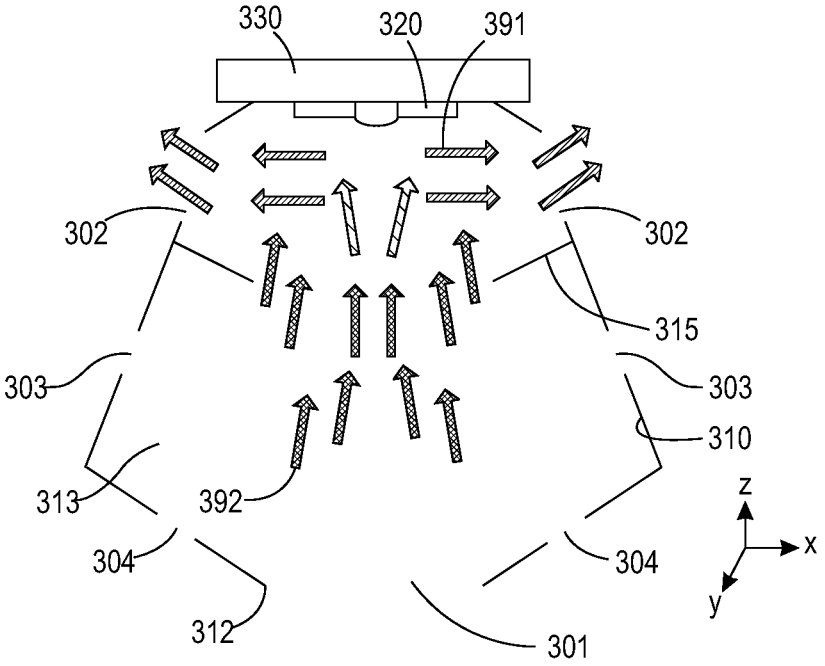
FIG. 4 diagrammatically illustrates convective airflow through the CATOD when the light bulb is oriented so that the CATOD extends from the base to the terminus in the negative z direction referred to as the "bulb down" orientation.

FIG. 3 diagrammatically illustrates convective airflow through the CATOD when the light bulb is oriented so that the CATOD 310 extends from the base 330 to the terminus 312 in the positive z direction referred to as the "bulb up" orientation. FIG. 4 diagrammatically illustrates convective airflow through the CATOD when the light bulb is oriented so that the CATOD 310 extends from the base 330 to the terminus 312 in the negative z direction, referred to as the "bulb down" orientation. For simplicity, the CA is omitted from FIGS. 3 and 4. In FIG. 3, when the LED light bulb is in the "bulb up" orientation, air 391 heated by the LED assembly 320 and the base 330 rises through the interior volume 313 of the CATOD 310 towards openings 301, 304. CATOD 310 may further include geometrical features and/or interior elements (e.g., shells with openings, spikes etc.) that provide enhanced surface area for heat exchange with air 391 as it rises through the interior of CATOD 310. Cooler ambient air 392 is drawn in through openings 302, 303, and flows in proximity to the surface of the base 330 and/or LED assembly 320, providing additional cooling for the base 330 and the LED assembly 320, in addition to removing the heat conducted away from the base 330 by the CATOD 310 itself.

As illustrated in FIG. 4, when the light bulb is oriented in the "bulb down" orientation, air 391 heated by the LED assembly 320 and/or the base 330 flows through nearby holes 302 and exits the interior volume 313. The exit of warmer air through holes 302 draws in cooler ambient through openings 301, 303, 304 in CATOD 310. The cooler air flows over the base 330 and/or LED assembly 320, providing air cooling for these components 330, 320 , in addition to removing the heat conducted away from the base 330 by the CATOD 310 itself. In some configurations, the TOD may include one or more baffles 315 that protrude into the interior volume 313 and that serve to direct the convective airflow to enhance the overall heat transfer rate and also provide increased surface area in the interior of the CATOD in contact with the air. In some cases, the baffles may be capable of moving from a first position (for a light bulb up orientation) to a second position (for a light bulb down orientation). The first position of the baffles may be designed to provide optimal convective airflow when the light bulb is in the light bulb up orientation and the second position of the baffles may be designed to provide optimal convective airflow when the light bulb is in the light bulb down orientation.

Figure 5:
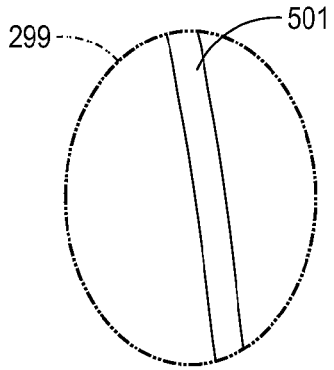
FIGS. 5-7 show various configurations for structural elements of the CATOD.

Referring again to FIG. 2B, circle 299 indicates a cross sectional portion of a structural element 211 of the TOD 210. The TOD may be formed according to various configurations, some of which are illustrated in the inset drawings 299 of FIG. 5-7. For example, in some implementations, as illustrated by FIG. 5, the TOD may be formed of a material 501 (e.g., a single homogenous material or in some cases, a homogenous mixture of materials), having properties of both suitable thermal conductivity (e.g., thermal conductivity greater than about 100 W/mK or even greater than about 150 W/mK) and which can provide the specified optical diffusion for the TOD. Materials used for a TOD of this construction include metals, metallic alloys, sintered metals, thermally conductive ceramic, thermally conductive polymer, mica, diamond, and/or other materials that can provide desired heat sinking/transfer capacity and light diffusion. The material used for the TOD may be optically opaque or optically transmissive, e.g., having optical transmittance greater than about 50% or even greater than 75% for visible light, and/or the material used for the TOD may be optically reflective, e.g. having reflectivity greater than about 70% for visible light. Suitable optically transmissive materials include diamond, mica, and/or transparent metals or metal oxides, such as indium tin oxide (ITO). Suitable optically reflective materials can include ceramics, plastics, polymers, and metals, for example. The reflectivity of a material depends on the surface finish of the material.

The TOD, the CA, or the entire CATOD may be formed by casting, stamping, molding, machining, cutting, 3-D printing, selective laser sintering (SLS), or any other suitable fabrication process. The TOD, the CA or the entire CATOD and/may be a single cast, stamped, molded, machined, etc., component, or may be component assembled from cast, stamped, molded, machined, etc., piece parts. All or a portion of the interior and/or exterior surfaces of the CATOD may be surface treated to achieve specified optical characteristics. For example, all or a portion of the surfaces of the CATOD may be surface treated, such as by polishing or roughening.

Figure 6:
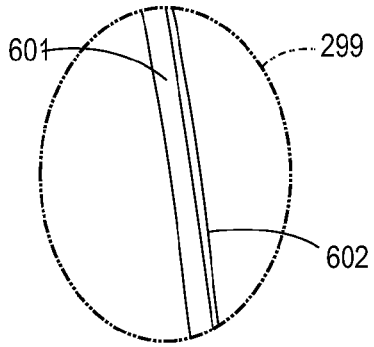

In some configurations, illustrated by cross section shown in FIG. 6, the TOD may comprise a layered structure. One or more of the structural elements of the TOD may comprise a number of layers 601, 602 that contribute to the thermal and optical diffusion capabilities of the TOD, either individually or in combination with each-other. In some configurations, a first layer 601, e.g., oriented away from the interior volume (213 in FIG. 2B) of the TOD, may comprise a material that provides suitable thermal conductivity for the TOD. A second layer 602, which in some cases may be thinner than layer 601, may comprise a different material or the same material as the first layer 601, differently treated, that provides for diffusion or reflection of light. The second layer 602, may comprise a roughened surface, a micro-structured surface, an embossed surface, a coated surface, e.g., phosphor coated surface, a specularly or diffusively reflective surface, for example. In some cases, both layers 601, 602 may transmit light, and in some cases, both layers may be opaque.

Figure 7:
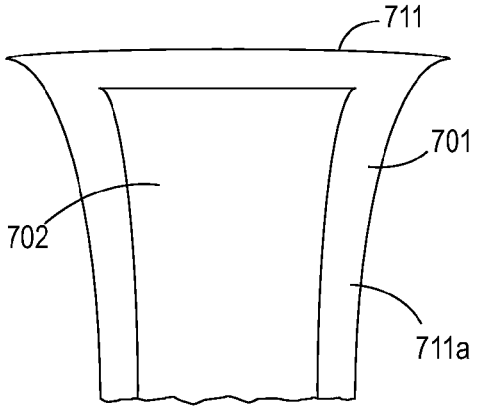

FIG. 7 shows an inner surface 711*a* of structural element 711 of a TOD. The inner surface 711*a* is oriented facing the TOD's interior volume. In the arrangement of FIG. 7, the TOD structural element 711 comprises multiple regions of different materials 701, 702 Although two regions are shown in FIG. 7, more than two regions are possible. One of the regions may be optically transmissive or reflective, while another of the regions is opaque or non-reflective. For example, one of the regions may be opaque and may provide the TOD with suitable thermal conductivity, whereas another of the regions may have relatively high thermal conductivity, but may provide characteristics of reflectivity or light transmission that provides for optical diffusion of the TOD.

Figure 8:
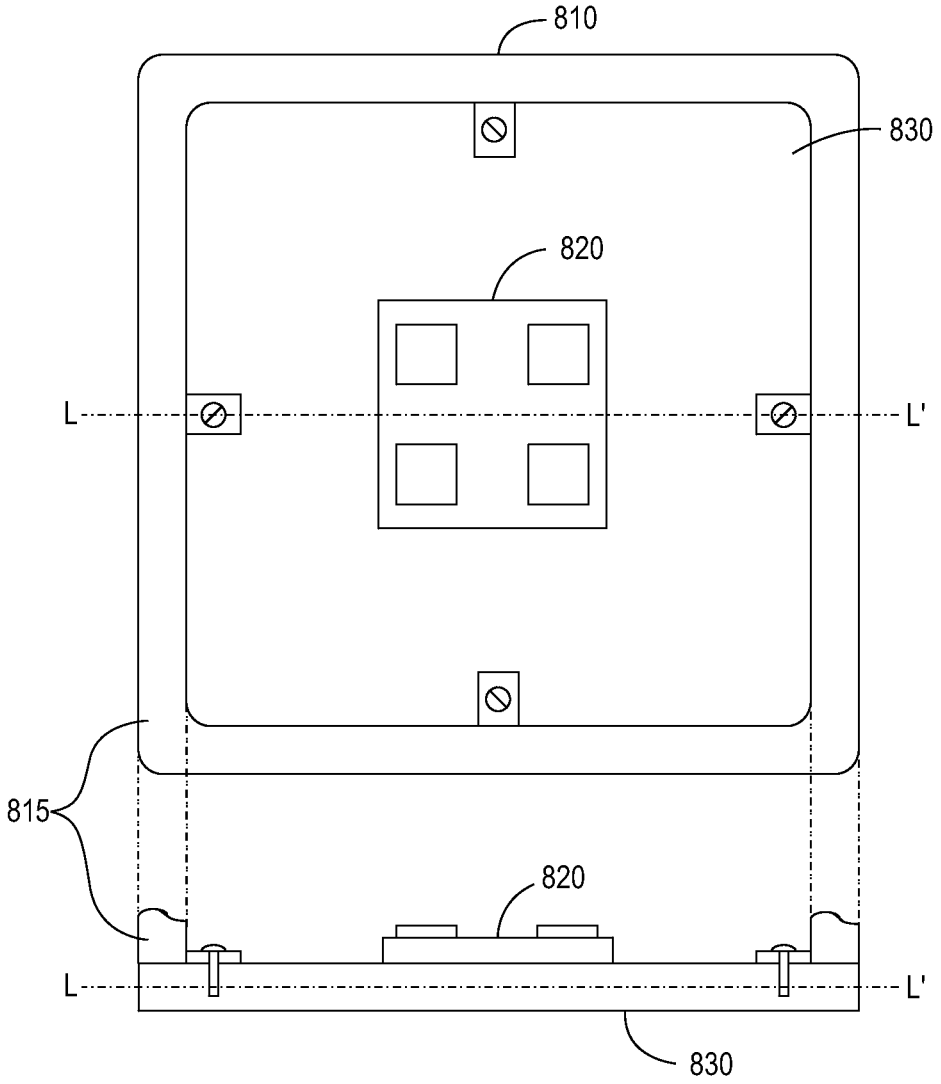
FIGS. 8-10 show configurations for mechanical and thermal connection of the CATOD and the base.
Figure 9:
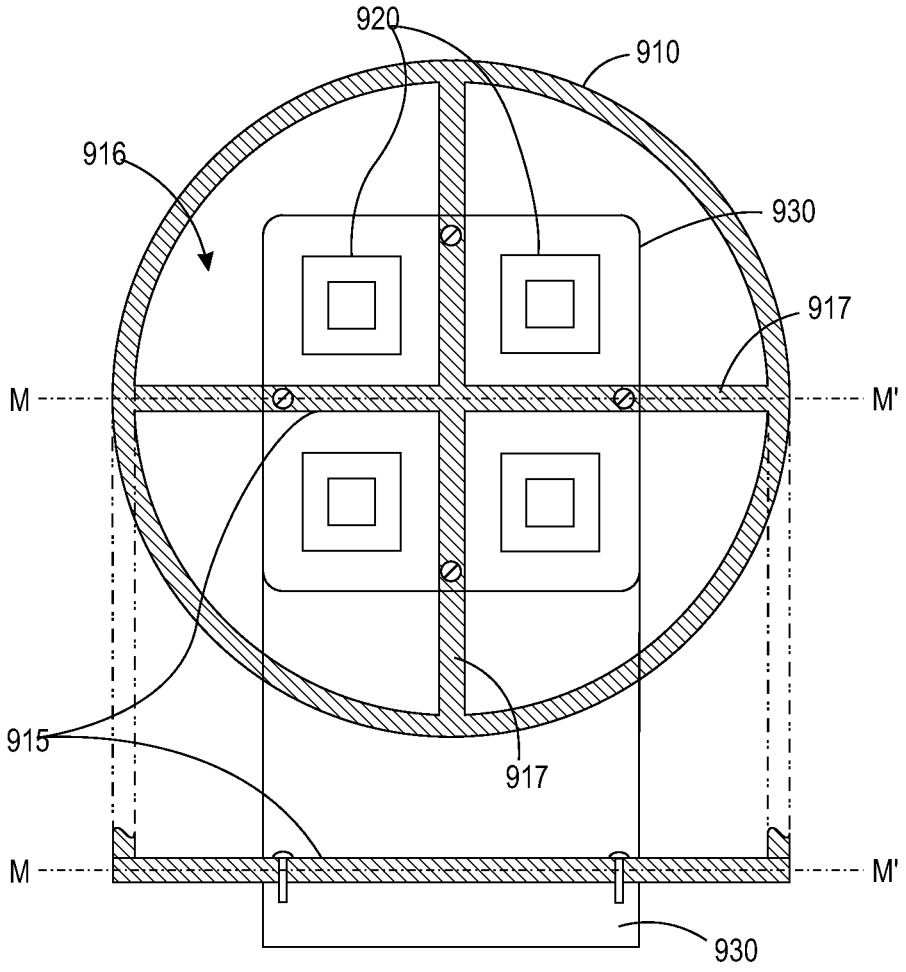
Figure 10:
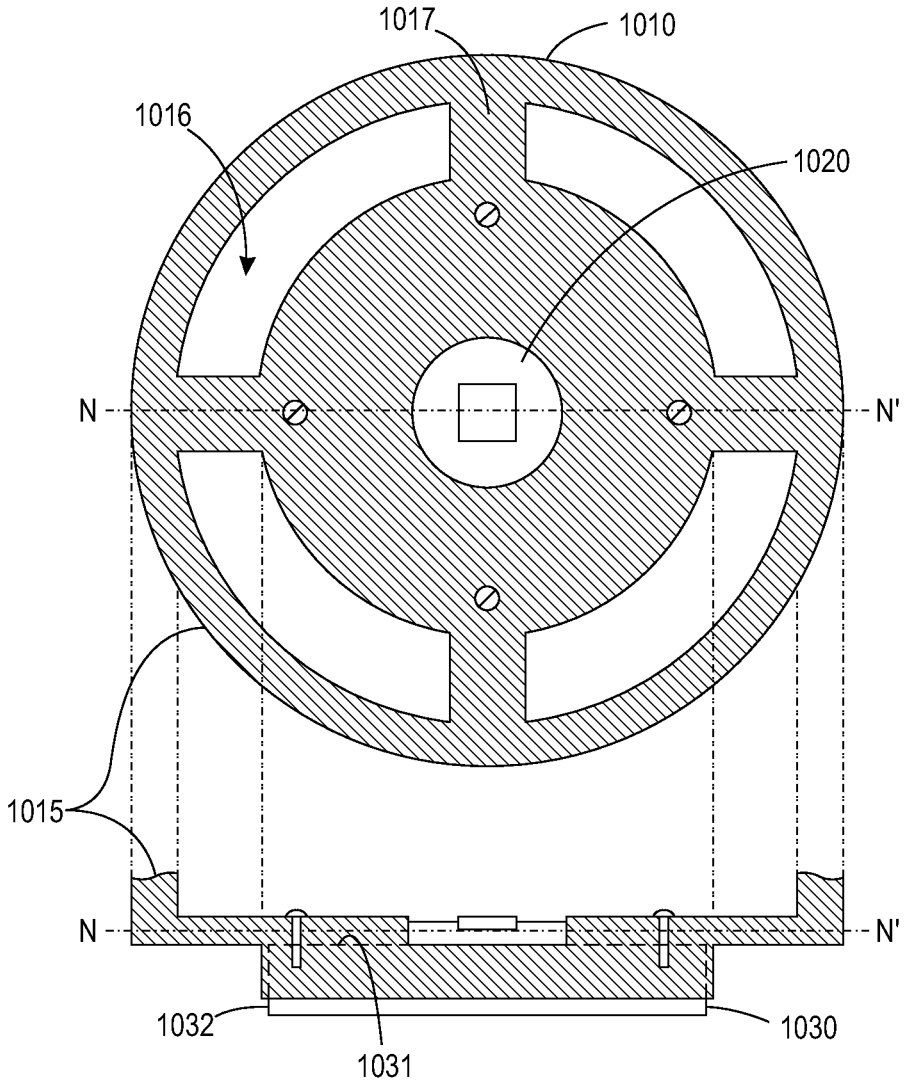

FIGS. 8-10 show a few of many configurations for mechanical and thermal connection of the CATOD and the base. As illustrated in FIGS. 8-10, the CATOD 810, 910, 1010 includes a mounting portion 815, 915, 1015 that is mechanically and thermally coupled to the base 830, 930, 1030. In each illustrated example, the mounting portion 815, 915, 1015 is disposed on the same surface 831, 931, 1031 of the base 830, 930, 1030 as the LED assembly 820, 920, 1020. In the example shown in FIG. 10, the mounting portion 1015 of the CATOD 1010 is disposed on the surface 1031 of the base 1030 and extends along the sides 1032 of the base 1030.

In FIGS. 9 and 10, the mounting portion 915, 1015 of the CATOD 910, 1010 extends beyond the base surface 931, 1031 in the xy plane, although this need not be the case, as illustrated in FIG. 8. As shown in FIGS. 9 and 10, if the mounting portion of the CATOD 915, 1015 is larger in the xy plane than the base 930, 1030 at the base surface 931, 1031, openings 916, 1016 may be located between the CATOD 910, 1010 and base 930, 1030 which facilitates air flow into or out of the interior volume of the CATOD 910 1010.

FIG. 8 shows a plan view of a mounting portion 815 of an exemplary TOD CA810 along with a cross section view taken along line L-L'. In this example, the mounting portion 815 of the CATOD 810 and the mounting surface 831 of the base 830 are commensurate in size and the mounting portion 815 of the CATOD 810 does not extend substantially beyond the base surface 831 in the xy plane. The mounting portion 815 of the CATOD 830 completely encircles the LED assembly 820. In some configurations, the mounting portion 815 may partially encircle the LED assembly 820. In some configurations, multiple LED assemblies may be used where the CATOD mounting portion encircles or partially encircles multiple LED assemblies mounted on the base surface. For example, in some cases, it can be helpful for heat dissipation if the LED assemblies are arranged at locations near, e.g., within a few millimeters of, the mounting portion of the CATOD.

The base 830 and the CATOD mounting portion 815 are both made of thermally conductive materials (the base and the CATOD mounting portion can be made of the same thermally conductive material). The mounting portion 815 has sufficient surface area in contact with the base 830 to provide a thermal resistance between the base 830 and the mounting portion 815 of the CATOD 810 of less than about 0.5° C./W. The base may be attached to the mounting portion by any suitable means, including welding, brazing, soldering, riveting, etc. The base may be attached to the mounting portion using thermal adhesive, removable screws (depicted in FIG. 8) detachable clamps and/or other means.

FIG. 9 shows a plan view of a mounting portion 915 of an exemplary CATOD 910 along with a cross section view taken along line M-M'. The configuration illustrated in FIG. 9 shows multiple LED assemblies 920 mounted on the surface 931 of the base 930. In this configuration, the mounting portion 915 of the CATOD 910 includes cross bars 917 that are disposed on the base surface 931 between the LED assemblies 920. This cross bar arrangement may be used to help dissipate heat when multiple LED assemblies are used. The LED subassemblies 920 may be located a few millimeters from the cross bars 917. As previously mentioned, if the mounting portion 915 of the CATOD 910 is larger in the xy plane than the surface 931 of the base, then gaps or openings 916 may be present between the CATOD 910 and the base 930 which can provide air flow between the ambient environment and the interior volume of the CATOD 910.

FIG. 10 shows a plan view of a mounting portion 1015 of an exemplary CATOD 1010 along with a cross section view taken along line N-N'. FIG. 10 illustrates a mounting portion 1015 that covers a majority of the base surface 1031, with bars 1017 that may extend beyond the base surface 1031. Openings 1016 are located between the edge of the base 1030 and the CATOD mounting portion 1017. In this example, the CATOD mounting portion 1015 also extends along the sides 1032 of the base 1030. In some examples, as illustrated by FIG.10, a surface area of a mounting portion of the thermal optical diffuser that is in contact with the base may occupy at least 70%, at least 80%, or even at least 90% of the available surface area of the base surface. Note that the term "available space" refers to the surface area of the base that is accessible to mount the CATOD.

Figure 11:
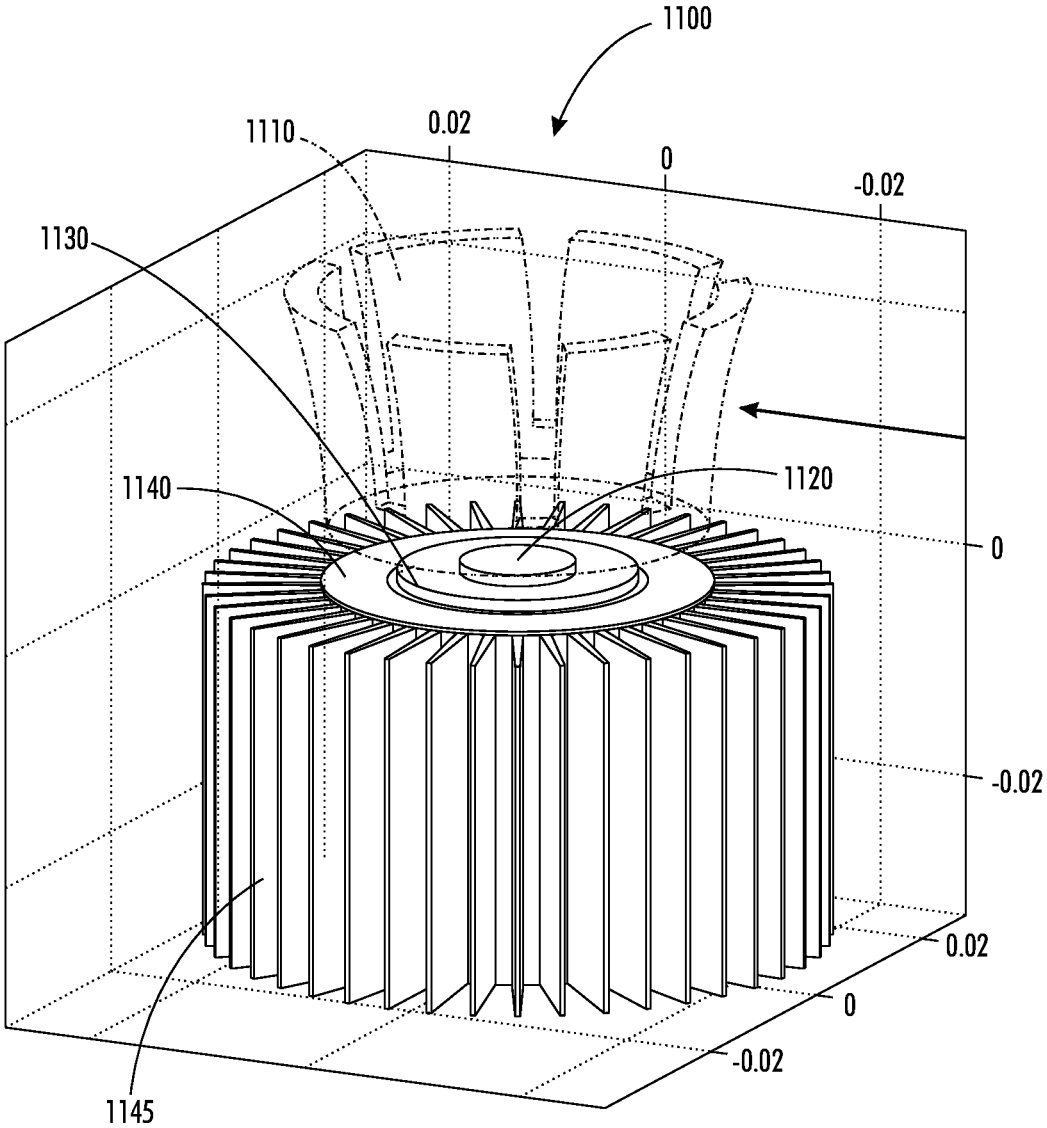
FIG. 11 depicts an LED bulb subassembly that includes a CATOD and a case configured to contain the driver electronics for the LED(s)

In an LED light bulb, the one or more LEDs are electrically connected to driver electronics which operate to condition the input voltage to the LEDs, among other functions. The driver electronics generate heat, and the use of a second heat sink can be beneficial to dissipate heat generated by the driver electronics. FIG. 11 depicts an LED bulb subassembly 1100 that includes a case 1140 configured to contain the driver electronics (not visible in FIG. 11). The case 1140 has an integral heat sink or is coupled to a heat sink 1145. In the illustrated embodiment, the heat sink 1145 includes radially projecting fins. The LED assembly 1120 is disposed on a first surface of the base 1130 (along with the CATOD 1110) and the opposing surface of the base 1130 is disposed on the case 1140 that contains the electronics. The case 1140 and its associated heat sink 1145 may or may not be thermally coupled to the base 1130. In thermally coupled implementations, the thermal resistance between the second heat sink 1145 and the base 1130 is less than 0.5° C./W.

Figure 12:
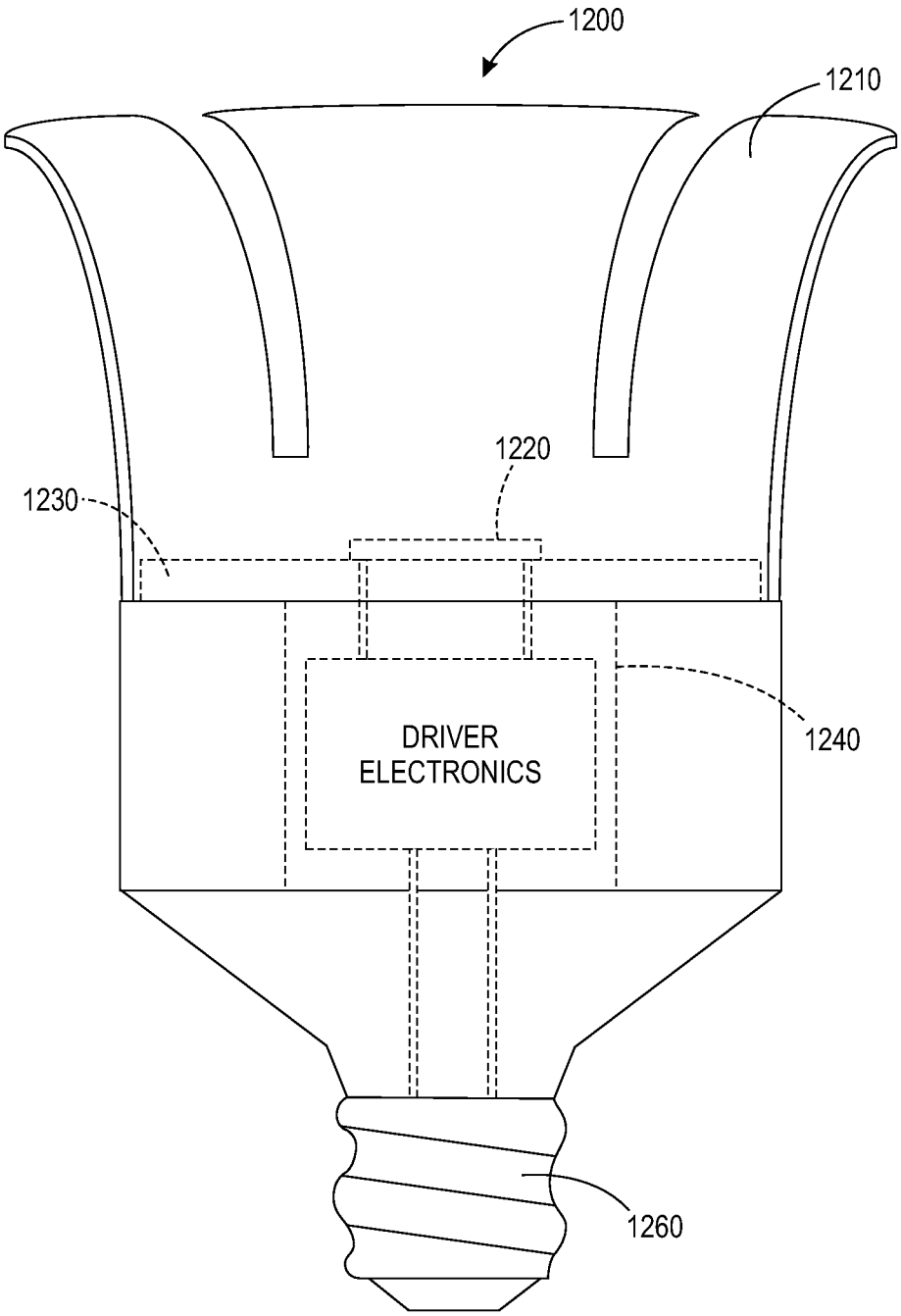
FIG. 12 shows the LED bulbs described herein disposed in a standard A-type incandescent light bulb form factor with an Edison base.

The LED bulbs described herein are suitable replacements for standard incandescent light bulbs, such as the A-type incandescent light bulb with an Edison base 1260, as depicted in FIG. 12. FIG. 12 shows the LED light bulb 1200 including driver electronics disposed in a case 1240 and electrically coupled between the base 1260 and the LED assembly 1220. The LED assembly 1220 is disposed on a thermally conductive base 1230. A CATOD 1210 is mounted on the same surface of the base 1230 as the LED assembly 1220 and is formed of one or more materials that provide both dissipation of heat generated by the LED and diffusion of light generated by the LED. The LED bulbs having CATOD configurations described herein can achieve light output levels equivalent to or exceeding 75 We or 100 We in the incandescent form factor, making a significant positive impact on the solid state lighting market by opening the path for widespread adoption of retrofit LED bulbs at the true 75 We and 100 We replacement levels.

The arrangement of the openings and/or transmissive regions of the TOD in conjunction with the optical elements of the CA can be designed to provide a desired output profile and light field from the LED bulb, such as, task lighting with narrow focus, ambient lighting with broad symmetrical distribution of light all around the bulb, and spot lighting with desired light output cone angle and brightness. For example, the TOD may include structural elements, openings and/or transmissive regions and the CA may include supporting structure and/or optical elements arranged to provide a predetermined cone angle of light, e.g., a cone angle of about 30 to 60 degrees.

The structural elements, openings and/or transmissive regions of the TOD and/or the supporting structure and/or optical elements of the CA may be arranged in any way, such as a regular pattern or an irregular, random, pseudorandom, or fractal arrangement. The spatial arrangement of the elements, features, and/or portions of the TOD (e.g., regular, irregular, random, pseudorandom, and/or fractal) in conjunction with the CA supporting structure, optical elements, and/or other portions of the CA (e.g., regular, irregular, random, pseudorandom, and/or fractal) can be selected to achieve specified thermal and/or optical characteristics. For example, as a light diffuser, the CATOD may be configured to achieve similar optical characteristics when compared with an incandescent light bulb of a watt equivalent capacity.

Figure 13A:
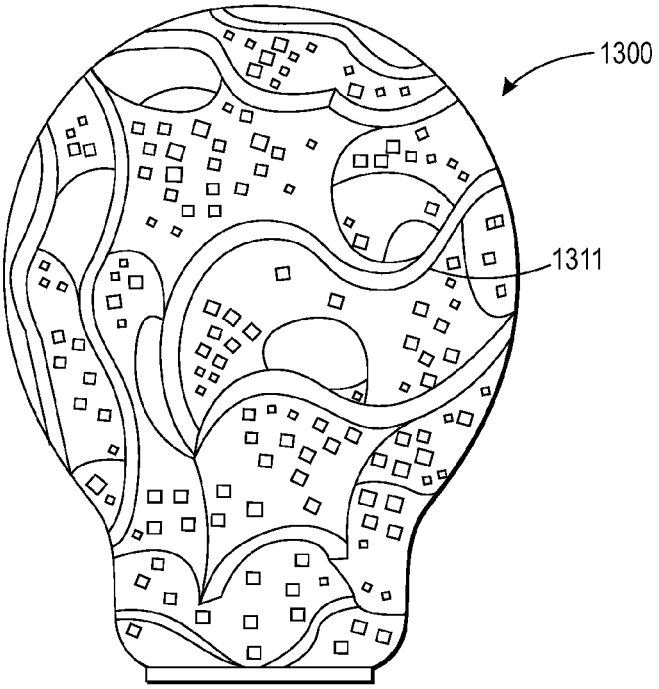
FIG. 13A illustrates a CATOD having irregular optical features.

The TOD and/or CA may have a spatially irregular configuration, meaning that there is no discernible pattern to the arrangement of at least some of the elements and/or components of the TOD and/or CA. FIG. 13A depicts and external view of a configuration of a CATOD 1300 with a spatially irregular configuration. In this example, the structural element(s) of the TOD 1310 present a spatially irregular arrangement that includes an undulating edge 1311.

Figure 13B:
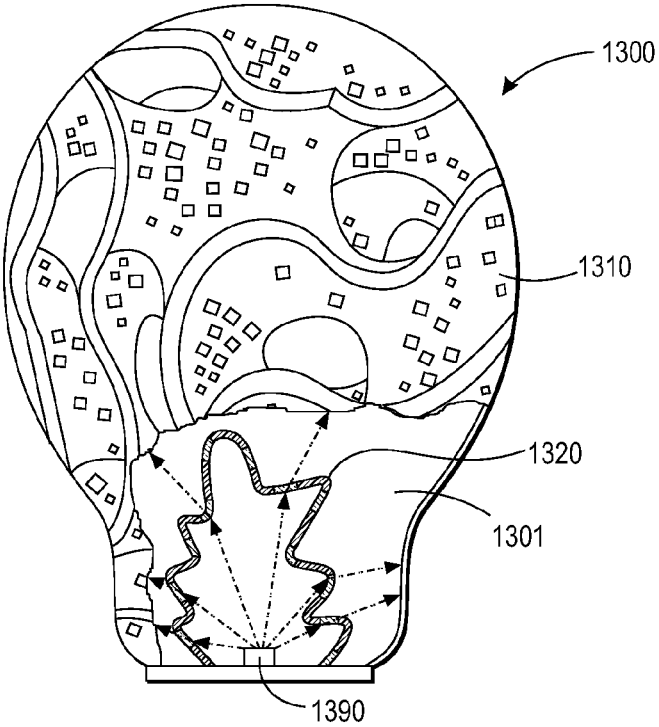
FIG. 13B is a cutaway view of the CATOD of FIG. 13A showing the condenser array disposed in the interior volume.

FIG. 13B is a cutaway view of the CATOD 1300 that depicts the CA 1320 and LED 1390 disposed within the interior volume 1301 of the CATOD. The CA 1320 includes optical elements having an irregular arrangement that allows light emitted by the LED to be directed and of focused towards the openings and/or optically transmissive regions of the TOD 1310.

Figure 13C:
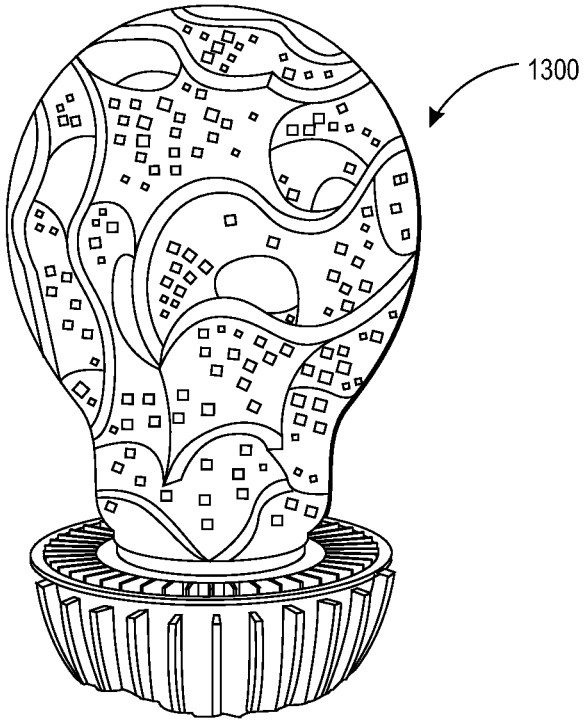
FIG. 13C shows the CATOD of FIG. 13A deployed on a base.

FIG. 13C shows an LED light bulb that includes the CATOD 1300 installed on the surface of a base along with an LED assembly. The spatially regular or irregular arrangement of the structural elements and/or optical features of the CATOD can serve to achieve specified optical and/or thermal characteristics. For example, the structural geometry of the CATOD 1300 may be selected such that it provides a surface area in contact with ambient air of at least 4 square centimeters for every cubic centimeter of volume of the diffuser. The structural geometry enhances total light output of the LED light bulb, enabling overall bulb dimensions similar to an incandescent bulb of equivalent luminosity while simultaneously providing substantial heat removal from the light emitting side of the LED bulb through natural convection and enhanced surface area of the CATOD 1300 in contact with the air.

Systems, devices, or methods disclosed herein may include one or more of the features, structures, methods, or combinations thereof described herein. For example, a device or method may be implemented to include one or more of the features and/or processes described herein. It is intended that such device or method need not include all of the features and/or processes described herein, but may be implemented to include selected features and/or processes that provide useful structures and/or functionality.

In the detailed description, numeric values and ranges are provided for various aspects of the implementations described. These values and ranges are to be treated as examples only, and are not intended to limit the scope of the claims. For example, embodiments described in this disclosure can be practiced throughout the disclosed numerical ranges. In addition, a number of materials are identified as suitable for various facets of the implementations. These materials are to be treated as exemplary, and are not intended to limit the scope of the claims.

The foregoing description of various embodiments has been presented for the purposes of illustration and description and not limitation. The embodiments disclosed are not intended to be exhaustive or to limit the possible implementations to the embodiments disclosed. Many modifications and variations are possible in light of the above teaching.

The invention claimed is:

1. A light emitting diode (LED) light bulb, comprising:

a thermally conductive base;

at least one LED assembly disposed on and thermally coupled to a surface of the base, the at least one LED assembly comprising at least one LED configured to emit light;

a thermal optical diffuser that defines an interior volume, the at least one LED arranged to emit light into the interior volume and through the thermal optical diffuser, the thermal optical diffuser disposed on the surface of the base and extending from the base to a terminus on a light emitting side of the LED assembly, the thermal optical diffuser including one or more openings; and an array of optical elements disposed within the interior volume and configured to direct the emitted light toward the openings, the thermal optical diffuser and the array of optical elements arranged to allow convective air flow between the interior volume of the thermal optical diffuser and ambient environment.

2. The LED light bulb of claim 1, wherein the thermal optical diffuser further comprises multiple optically transmissive regions that are spaced apart from each other by a thermally conductive material and the array of optical elements is configured to direct the emitted light toward the optically transmissive regions.

3. The LED light bulb of claim 1, wherein the array of optical elements is formed as a unitary structure.

4. The LED light bulb of claim 1, wherein the array of optical elements and the thermal optical diffuser are formed as a unitary structure.

5. The LED light bulb of claim 1, wherein the array of optical elements comprises one or both of refractive and diffractive optical elements.

6. The LED light bulb of claim 1, wherein the array of optical elements comprises at least one of:

an aperiodic array;

an anamorphic array;

an asymmetrical array.

7. The LED light bulb of claim 1, wherein the array of optical elements comprises at least one of:

a periodic array a symmetrical array; and a radially symmetrical array.

8. The LED light bulb of claim 1, wherein the optical elements have substantially similar optical characteristics.

9. The LED light bulb of claim 1, wherein optical characteristics of some of the optical elements of the array are dissimilar from optical characteristics of other optical elements of the array.

10. The LED light bulb of claim 1, wherein portions of the array of optical elements are thermally conductive.

11. The LED light bulb of claim 1, wherein the thermal optical diffuser comprises an exterior surface that is oriented toward the ambient environment and has a surface area greater than 4 $cm^2$ per about 1 $cm^3$ of interior volume.

12. The LED light bulb of claim 1, wherein the thermal optical diffuser comprises a material that has a thermal conductivity greater than about 100 W/(mK).

13. The LED light bulb of claim 1, wherein the one or more openings are arranged so that ambient air flows into the interior volume and the ambient air makes contact with a light emitting surface of the at least one LED.

14. The LED light bulb of claim 1, wherein the LED assembly, thermal optical diffuser, and optical array cooperate to provide optical characteristics similar to an incandescent light bulb of similar luminosity.

15. A light emitting diode (LED) light bulb, comprising:

a thermally conductive base;

at least one LED assembly disposed on and thermally coupled to a surface of the base, the at least one LED assembly comprising at least one LED configured to generate light;

a thermal optical diffuser that defines an interior volume, the at least one LED configured to emit light into the interior volume and through the thermal optical diffuser, the thermal optical diffuser disposed on the surface of the base and extending from the surface of the base to a terminus, the thermal optical diffuser comprising a material having a thermal conductivity greater than about 100 W/(mK); and an array of optical elements disposed within the interior volume and configured to focus the emitted light toward optically transmissive regions of the thermal optical diffuser, the thermal optical diffuser and the array of optical elements arranged to allow convective air flow between the interior volume of the thermal optical diffuser and ambient environment.

16. The LED light bulb of claim 15, wherein the LED assembly has a light emitting side and a non-light emitting side, the thermal optical diffuser located on the light emitting side, and the LED light bulb further comprising:

electronics configured to control operation of the LED, the electronics disposed in a case located on the non-light emitting side; and a heat sink thermally coupled to the case.

17. A subassembly for light emitting diode (LED) light bulb, comprising:

a thermal optical diffuser that defines an interior volume such that light emitted by an LED disposed within the interior volume travels in the interior volume and emerges through the thermal optical diffuser, the thermal optical diffuser configured to extend on the light emitting side of the LED light bulb from a base mounting portion to a terminus, the thermal optical diffuser including one or more openings extending between the interior volume and ambient environment; and an array of optical elements disposed within the interior volume and configured to focus the emitted light toward the openings, the thermal optical diffuser and the array of optical elements arranged to allow convective air flow between the interior volume of the thermal optical diffuser and the ambient environment.

18. The subassembly of claim 17, wherein optical characteristics of some of the optical elements of the array are dissimilar from optical characteristics of other optical elements of the array.

19. The subassembly of claim 17, wherein portions of the array of optical elements are thermally conductive.

20. The subassembly of claim 17, wherein the thermal optical diffuser comprises an exterior surface that is oriented toward the ambient environment and has a surface area greater than 4 $cm^2$ per about 1 $cm^3$ of interior volume.

* * * * *